US005323491A

United States Patent [19]

Barrett, Jr.

[11] Patent Number: 5,323,491

[45] Date of Patent: Jun. 28, 1994

[54] HEADGEAR FOR SHIELDING EARS AND NECK FROM ULTRAVIOLET RAYS

[76] Inventor: Charles R. Barrett, Jr., 10555 Paces Ave., Apt. 425, Matthews, N.C. 28105

[21] Appl. No.: 977,040

[22] Filed: Nov. 13, 1992

Related U.S. Application Data

[63] Continuation-in-part of Ser. No. 807, Oct. 26, 1992.

[51] Int. Cl.[5] ..... A42B 5/00

[52] U.S. Cl. ..... 2/207; 2/172; 2/DIG. 11

[58] Field of Search ..... 2/171, 172, 181, 207, 2/DIG. 11, 7, 185 R, 192, 198, 199; D2/253, 509, 512, 513, 514

[56] References Cited

U.S. PATENT DOCUMENTS

| | | | |
|---|---|---|---|
| 781,232 | 1/1905 | Saks | 2/207 |
| 2,767,404 | 10/1956 | Collins | 2/207 |
| 4,856,116 | 8/1989 | Sullivan | 2/DIG. 11 |
| 4,980,928 | 1/1991 | Ellis | 2/199 |
| 5,046,195 | 9/1991 | Koritan | 2/172 |
| 5,105,476 | 4/1992 | Cox | 2/181 |
| 5,121,507 | 6/1992 | Brown | 2/172 |
| 5,138,720 | 8/1992 | Campbell | 2/207 |
| 5,153,943 | 10/1992 | Clement | 2/172 |
| 5,161,259 | 11/1992 | Shorts | 2/199 |
| 5,161,260 | 11/1992 | Reynolds | 2/207 |

*Primary Examiner*—Clifford D. Crowder
*Assistant Examiner*—Diana L. Biefeld
*Attorney, Agent, or Firm*—Ralph H. Dougherty

[57] ABSTRACT

An improved device for protective headgear for shielding ears and neck from ultraviolet rays which can be worn alone or in conjunction with a hat. This device is a stretchable headband with a crescent shaped sun shield attached to the headband. The sun shield gathers slightly when worn, and extends outwardly from the head so that it does not lay directly over the ears. The shield is made of a tightly woven material which is also breathable, a single ply or preferably a two-ply material with a tightly woven micro denier on the outside and an all-cotton liner on the underside which will be in contact with the back of the neck. A method for making the device also disclosed.

15 Claims, 2 Drawing Sheets

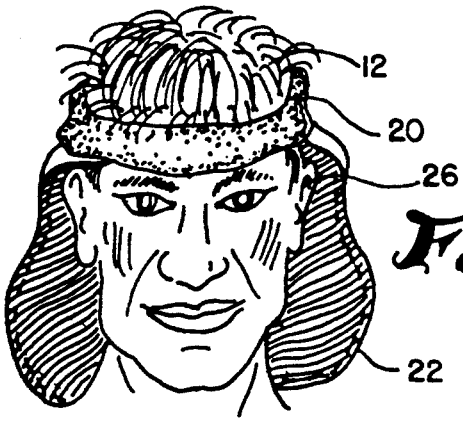
Fig. 1
Fig. 2
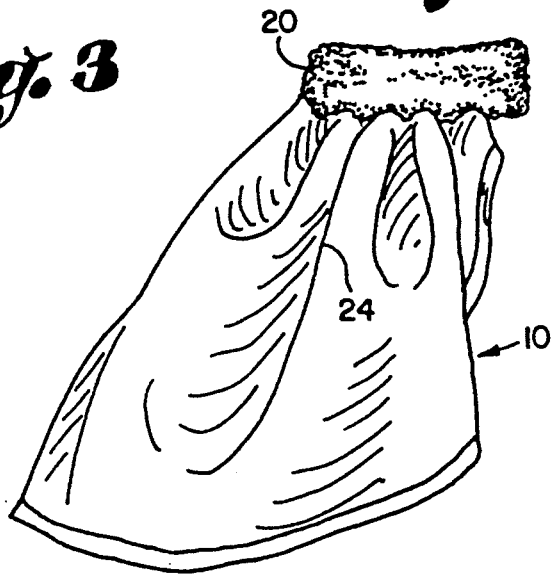
Fig. 3
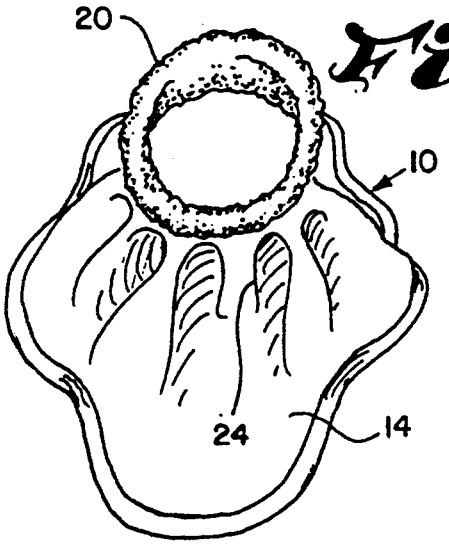
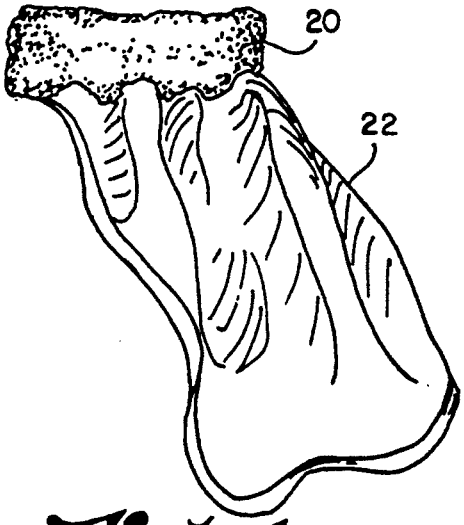
Fig. 4
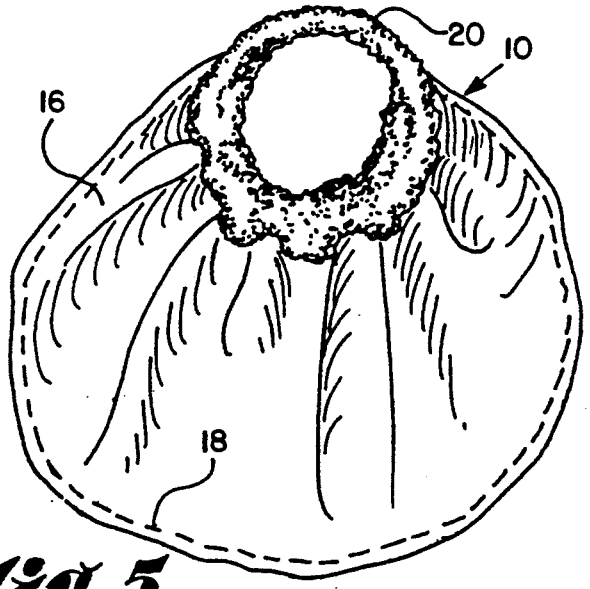
Fig. 5

HEADGEAR FOR SHIELDING EARS AND NECK FROM ULTRAVIOLET RAYS

CROSS REFERENCE TO RELATED APPLICATION

This application is a continuation-in-part of co-pending application Ser. No. 29/000,807 filed Oct. 26, 1992.

FIELD OF THE INVENTION

The present invention relates to a method and apparatus for protecting a person's ears and neck from harmful ultraviolet rays, and more particularly to protective headgear apparatus which is both comfortable to wear and provides a higher degree of protection against harmful rays from the sun than currently is available in protective headgear.

BACKGROUND OF THE INVENTION

In the United States during 1990 there were more than a half million expected new cases of skin cancer reported according to the Skin Cancer Foundation in New York City. What is most alarming is that over the past decade the incidence of malignant melanoma, the most serious type of skin cancer, has almost doubled. Some dermatologists have called this situation an epidemic. In 1930 the lifetime risk of developing melanoma was 1 chance in 1,500. Today the risk has increased to 1 chance in 150. According to New York University researchers Darrell Rigel, Alfred Kopf and Robert Friedman, the risk in the year 2000 will be as high as 1 in 90.

The evidence is overwhelming that ultraviolet radiation from the sun is a major cause of melanoma. It has been shown that taking protective measures, like applying sun screen or wearing protective clothing while outdoors, could prevent a significant number of these tumors.

Skin cancer is most common in areas of the world where sunlight is the most intense. People with light skin have little in the way of protective skin pigment, therefore they also have a proportionately higher chance of contracting skin cancer if they sunbathe regularly. The probability is increased if they have suffered from a severe sunburn as a child.

In recent years, scientists have become worried about the effect of the depletion of the ozone layer on the incidence of skin cancer. The ozone layer located in the stratosphere shields life on earth from the sun's harmful ultraviolet radiation. Depletion of the ozone layer has been observed near the North and South poles. Meteorologist Joseph Farman and his colleagues at the British Antarctic Survey, in Antarctica in 1985 discovered a hole in the ozone layer. Today, scientists know that holes in the ozone layer exists over both the North and South poles. These holes, along with the general depletion of ozone, allow more ultraviolet radiation to reach the earth. Theoretically, this situation will cause an increase in the occurrence of skin cancer. EPA consultant Janice D. Longstreth predicts that an additional 154 million skin cancer cases and 3.2 million skin cancer deaths worldwide will occur among people born before 2075. It is apparent that steps must be taken to stop ozone depletion as well as develop new protection for people who must live with the higher levels of UV radiation caused by this ozone depletion.

One way to reduce the risk of skin cancer is to wear a protective garment. Not all fabrics provide equal protection from ultraviolet radiation. However when a fabric is selected for this purpose, the wearer's comfort also needs to be taken into consideration.

Today the baseball cap is a popular means of protection from strong sunlight. However, the baseball cap provides only partial protection as it leaves the neck and ears exposed to ultraviolet (UV) radiation. Hats have been produced which offer greater protection to the neck and ears, but their acceptance has been low. Baseball caps are available today with a plethora of logos (everything from sports teams to product names). Many individuals become very attached to these hats and wouldn't think of wearing anything else. Therefore a real need exists for a ear and neck protector which can be worn in conjunction with a baseball cap or any type of hat which will provide superior protection from ultraviolet radiation.

DESCRIPTION OF THE PRIOR ART

Applicant is aware of the following U.S. Patents concerning protective headgear.

| U.S. Pat. No. | Issue Date | Inventor | Title |
|---|---|---|---|
| 4,091,469 | 05-30-1978 | Davidson | HEAD PROTECTION FOR USE WITH HARD HEAD GEAR |
| 4,821,341 | 04-18-1989 | Baptiste | SUN-VISOR AND HEADPIECE COMBINATION AND PACKAGE THEREFORE |
| 4,887,319 | 12-19-1989 | Daniels | UNITARY CONTIGUOUS FACE AND NECK PROTECTOR ALL WEATHER COVER FOR HARD HEAD GEAR |
| 5,027,438 | 07-02-1991 | Schwarze | OPERATING ROOM CLOTHING WITH COATED FABRIC |
| 5,048,128 | 09-17-1991 | Watson, Jr. | PROTECTIVE HEADWEAR |
| 5,077,836 | 01-07-1992 | Idoff | HEADGEAR |
| 5,083,317 | 01-28-1992 | DeMoreta | SUN SCREEN HAT |
| 5,091,995 | 03-03-1992 | Oates | SPORTS CAP |
| 5,097,534 | 03-24-1992 | Viemeister | PROTECTIVE GARMENT |
| 5,119,514 | 06-09-1992 | Woehl | EAR SHIELD CAP |

Davidson U.S. Pat. No. 4,091,469 teaches an apparatus for protecting a person's neck and ears from the elements when worn in conjunction with a hard hat, this device is fastened about the chin of the wearer utilizing a Velcro fastener. This patent differs significantly from the present invention as it is designed to be worn with a hard hat, it fastens about the chin to protect the wearer from cold weather conditions.

Daniels U.S. Pat. No. 4,887,319 discloses an apparatus for a unitary face and neck, all weather protector for hard head gear. This apparatus is designed to be worn with a hard helmet and to provide cover for the neck and ears. Like the Davidson patent, it also shows a closure around the chin area and is specifically for use in conjunction with a hard hat.

Baptiste U.S. Pat. No. 4,821,341 teaches a head covering which also provides protection for the ears and back of the neck, and incorporating a sun visor. Unlike the present invention, Baptiste covering lays over the tops of the ears of its wearer and the fabric from which it is constructed from offers only average protection.

Schwarze U.S. Pat. No. 5,027,438 discloses operating room clothing incorporating coated fabric.

Watson U.S. Pat. No. 5,048,128 teaches an article of protective headwear providing both a visor and fabric at the rear for protection of the ears and neck. There is no provision for it to stand off the neck and ears.

Idoff U.S. Pat. No. 5,077,836 teaches a basic headgear device. A visor or other protective equipment can be attached to this headgear.

DeMoreta U.S. Pat. No. 5,083,317 discloses a sun screen hat of stretchable material. In FIG. 1, number 40, indicates a round opening so that the apparatus can be worn about the head, but does not provide covering for the top of the head. In FIG. 4 note that while providing protection for the back of the neck, this apparatus is not made to cover the ears of the wearer. Further, in FIG. 4 reference numeral 82 denotes an integral visor, further differentiating this hat from the present invention.

Oates U.S. Pat. No. 5,091,995 teaches a sports cap that has a brim in the front and another in back. In this invention the rear brim can be detached and used independently of the rest of the hat.

Viemeister U.S. Pat. No. 5,097,534 teaches a protective garment especially suitable for use in the medical field. FIG. 1 shows this apparatus has a full headpiece 10, which exposes only the face of the wearer. In column 5, Viemeister discusses the use of micro porous material to produce this garment. His purpose is only to protect the wearer and patient during surgery, it was not intended to be worn as a shield from the UV rays of the sun.

Woehl U.S. Pat. No. 5,119,514 teaches a cap with a front brim and side brims to provide protection to the ears from the sun.

In addition to the patents listed above, applicant is aware of the following articles which deal with the UV protection of fabric:

Welsh C., Diffey B., *The Protection Against Solar Actinic Radiation Afforded by Common Clothing Fabric,* 6 Clinical Experimental Dermatology 577, 577–582 (1981);

Berne B., Fisher T., *Protective Effects of Various Types of Clothes Against UV Radiation,* 60 Acta Derm Venereol (Stockh) 459, 459–460 (1980);

Robson J., Diffey B., *Textiles and Sun Protection,* 7 Photodermatol Photoimmunol Photomed, 32, 32–34 (1990);

Jevtic A., *The Sun Protective Effect of Clothing, Including Beachwear,* 31 Australas J. Dermatol, 5, 5–7 (1990).

Welsh teaches that the "structure or weave, of a material is the most important factor in determining the protective nature of the material".

Berne teaches that the structure of the fabric is key to its UV protection, and that double layers and dark colors tend to increase protection.

Robson teaches that tightly woven fabrics provide the best protection from UV radiation and that open weave fabrics, like crepe, are poor.

Jevtic teaches the "tightness of the weave of the material, its color and thickness all significantly affect its relative opacity to ultraviolet light."

SUMMARY OF THE INVENTION

The present invention is a headgear for shielding ears and neck from ultraviolet rays. The invented headgear is comprised of a stretchable headband and a crescent shaped sun shield attached to the headband. Shape of the sun shield is extremely important. The crescent shape allows the sun shield to gather slightly and to extend outward from the head so that it does not lay directly over the ears. For optimum sun protection, a tightly woven material is used. However, for comfort this material also must be breathable. To provide greater comfort, the sun shield is made of a two ply material; a tightly woven micro denier which is light in color on the outside and an all-cotton liner for the underside which will be in contact with the back of the neck. Further, the two ply construction offers superior UV protection.

During normal operation, the invented headgear reflects light away from the neck and ears because of its light exterior color. This allows the sun shield to remain cool. Because of its crescent shape, the sun shield lays away from the neck and ears allowing air flow in the area to facilitate comfort. The back of the sun shield is preferably 100% cotton to be both breathable and absorbent. A high filament textile (like a micro denier) comprises the front of the shield which is both breathable, and especially effective at blocking transmission of ultraviolet rays because the weave is so tight.

The present invention is particularly useful for blocking ultraviolet rays to the neck and ears while remaining cool and comfortable to wear. When worn in conjunction with another head covering, such as a baseball cap, it provides effective protection from the harmful rays of the sun.

OBJECTS OF THE INVENTION

The principal object of the invention is to provide an improved method of shielding a persons ears and neck from harmful UV rays.

Another object of the invention is to provide apparatus for shielding a person's ears and neck from harmful UV rays.

Another object of the invention is to provide apparatus for shielding a person's ears and neck from harmful UV rays which would can be used in conjunction with a hat.

Another object of the invention is to provide apparatus for shielding a person's ears and neck from harmful UV rays which can be produced at a reasonable price.

Another object of the invention is to provide apparatus for shielding a person's ears and neck from harmful UV rays which would reflect light, yet the material is breathable so that it is cool to wear.

A further object of this invention is to provide a method of shielding a person's ears and neck from harmful UV rays while allowing a person to also wear a favorite hat.

BRIEF DESCRIPTION OF THE DRAWINGS

The foregoing and other objects will become more readily apparent by referring to the following detailed description and the appended drawings in which:

FIG. 1 is a front view of the invented headgear for shielding ears and neck from ultraviolet rays, in place on a wearer, and comprising a drape portion connected to an elastic band, whereby the drape tends to stand away from the ears and neck of the wearer.

FIG. 2 is a left side view of the invented headgear for shielding ears and neck from ultraviolet rays showing both the drape portion and the elastic headband.

FIG. 3 is an isometric top view of the invented headgear for shielding ears and neck from ultraviolet rays showing both the drape portion and the elastic headband.

FIG. 4 is a right side view of the invented headgear for shielding ears and neck from ultraviolet rays showing both the drape portion and the elastic headband.

FIG. 5 is a bottom view of the invented headgear for shielding ears and neck from ultraviolet rays showing both the drape portion and the elastic headband.

DETAILED DESCRIPTION

Figure 6:
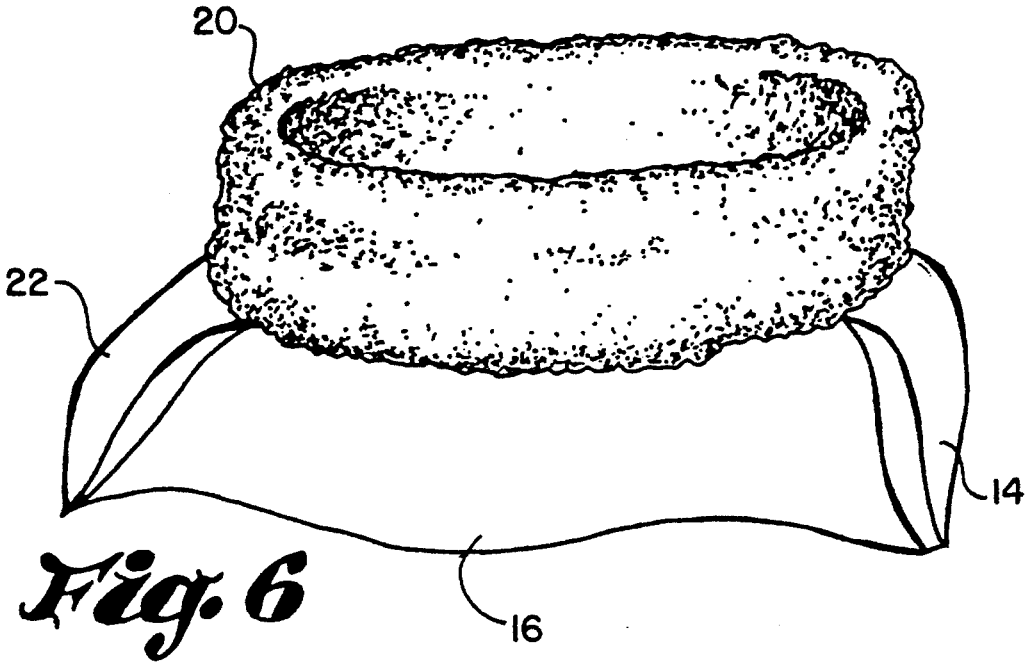
FIG. 6 is a partial isometric front view of the invented headgear for shielding ears and neck from ultraviolet rays on an enlarged scale showing the elastic headband and a portion of the drape.
Figure 7:
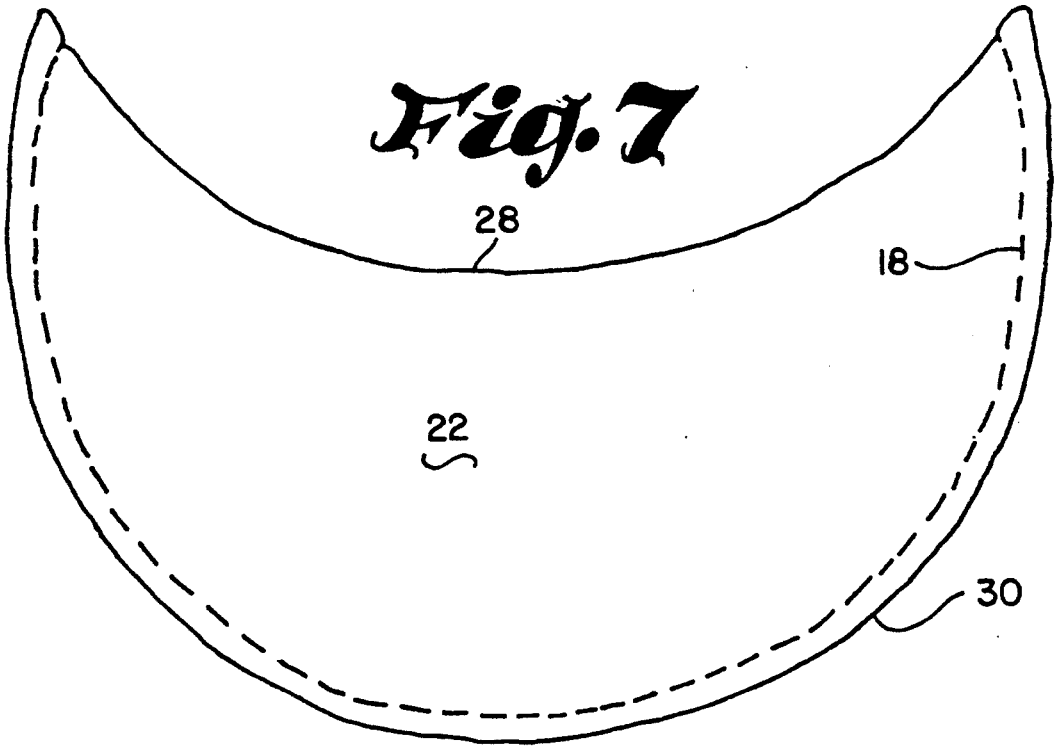
FIG. 7 is a plan view of the drape portion of the invented headgear for shielding ears and neck from ultraviolet rays prior to attachment to the elastic band.

Referring now to the drawings, and particularly to FIG. 1, the invented headgear device 10 is shown worn on a person's head 12. This protective headgear 10 is made up of two components: an elastic band 20, as shown in FIG. 6, and a crescent shaped sun shield 22, as shown in FIG. 7.

The elastic band 20 holds the protective headgear 10 securely about a person's head 12, as shown in FIG. 1, giving the present invention one size wearability. To increase comfort to the wearer, the elastic band 20 can be a knit cotton-elastic material, or it can be covered in terry cloth so that in either case it will be both soft and absorbent. Functionally shaped sun shield 22 can be a single ply, but is preferably two ply, the first ply being made of a light colored textile with a high filament count, such as a micro denier fabric 14, shown in FIG. 3, which is the side exposed to the sunlight, and the second ply being the same or another fabric 16, shown in FIG. 5, which is the side exposed to the back of the neck. Micro denier is a fine weave which is breathable. The micro denier fabric 14 is bonded to the cotton fabric 16 by means of a stitch 18. Both materials are then secured to the elastic band 20.

In manufacturing, the elastic band 20 is stretched out and the sun shield 22 is then fastened to the elastic band. The curved fabric edge 28 is attached directly to the outstretched elastic band 20. The curved fabric edge 28 at the top of the sun shield 22 is congruent with the central portion of the curved fabric edge 30 at the bottom of the sun shield. Because of the curved fabric edge 28, the sun shield 22 fabric gathers into pleats 24 when the elastic band 20 is allowed to contract. When worn, the curved fabric edge 28 causes the fabric to stand off the ears 26, and away from the neck. This configuration also allows for air to circulate between the head of the wearer and the sun shield which makes the present invention extremely comfortable to wear.

Fabrics suitable for the present invention include knitted fabrics, woven fabrics and non-woven fabrics. Woven fabrics are preferable to knitted fabrics. Suitable textiles include cotton, linen, nylon, silk, dacron, polyesters, or combinations of any of these. Non-woven fabrics include plastics, paper and paper-type fabrics.

ALTERNATIVE EMBODIMENTS

Dark fabrics are superior at blocking light, but they also tend to retain heat. There are situations in which it is desirable to block out the UV rays to the ears and the back of the neck while keeping those areas warm, such as snow skiing. In that case it will is desirable to use a dark colored micro denier 14 on the outside of the sun shield 22, as shown in FIG. 3. To improve the warmth factor heavy cotton or a wool fabric may be used as the inside ply 16 of the sun shield 22.

The sun shield 22 of the present invention is an ideal location to display trademarks and logos for advertising purposes. At concerts and sporting events where people may have to stand in long lines outside there is a need to provide protection to the back of the neck and ears. As people stand in line, they tend to look at the back of many heads.

SUMMARY OF THE ACHIEVEMENT OF THE OBJECTS OF THE INVENTION

From the foregoing, it is readily apparent that I have invented an improved method and apparatus for the protection of the ears and neck from harmful ultraviolet rays. This apparatus can be used in conjunction with a hat and will reflect light, yet the material is breathable so that it is cool to wear and can be produced at a reasonable price.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. Headgear apparatus for shielding ears and neck from ultraviolet rays comprising:
   - an elastic head band;
   - a crescent shaped sun shield having an upper concave curved fabric edge and a lower convex curved fabric edge which intersect each other as to form points, said concave curved fabric edge having a shallow curvature;
   - said crescent shaped sun shield being attached to said elastic band along the entire length of said concave curved fabric edge;
   - said sun shield having a width sufficient to cause formation of pleats to lay away from the wearer's neck and ears.

2. Apparatus according to claim 1 where said sun shield is made from a micro denier fabric having photoprotective properties.

3. Apparatus according to claim 2 where said micro denier fabric is a light color.

4. Apparatus according to claim 3 where said micro denier material is white.

5. Apparatus according to claim 2 where said micro denier material is dark in color.

6. Apparatus according to claim 5 where said micro denier material is black.

7. Apparatus according to claim 1 where said sun shield is made of a two ply material.

8. Apparatus according to claim 7 comprising:
   - an exterior fabric adapted for direct exposure to sun light;
   - an interior fabric underlying backing and sewn to said exterior fabric;
   - said exterior fabric being a micro denier;
   - said interior fabric being selected from the group consisting of cotton, wool, linen, nylon and silk.

9. Apparatus according to claim 1 where said sun shield is printed with indicia.

10. Apparatus according to claim 9 where said indicia is selected from the group consisting of: a picture, logo, trademark, advertising material.

11. Apparatus according to claim 1 where said sun shield is made from at least one material selected from the group consisting of knitted fabrics, woven fabrics, and non-woven fabrics.

12. Apparatus according to claim 1 where said sun shield is made from at least one material selected from the group consisting of cotton, linen, silk, wool, nylon, dacron, polyester, and combinations thereof.

13. Apparatus according to claim 1 wherein said elastic head band is made from a knit cotton-elastic material, whereby said elastic head band is both soft and absorbent.

14. Apparatus according to claim 13 further comprising a terry cloth covering over said knit cotton-elastic material.

15. A method of manufacturing a headgear for shielding a wearer's ears and neck from ultraviolet rays comprising:

forming an elastic band into a loop;

forming a crescent shaped sun shield with two curved fabric edges, one of which is concave;

stretching the elastic band;

attaching the crescent shaped sun shield about a portion of the concave curved fabric edge to the stretched band; and allowing the elastic band to contract to its original shape;

whereby the sun shield gathers into pleats which, upon wearing, force the sun shield to assume an orientation tending away from the neck and ears of the wearer.

* * * * *